US007614373B2

(12) United States Patent
Shouji et al.

(10) Patent No.: US 7,614,373 B2
(45) Date of Patent: Nov. 10, 2009

(54) OIL PASSAGE CONSTRUCTION FOR DIE-CAST FORMED PRODUCT, AND OIL PASSAGE CONSTRUCTION FOR INTERNAL COMBUSTION ENGINE

(75) Inventors: Junpei Shouji, Toyota (JP); Hiromichi Hashimoto, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/593,031

(22) Filed: Nov. 6, 2006

(65) Prior Publication Data

US 2007/0107686 A1 May 17, 2007

(30) Foreign Application Priority Data

Nov. 11, 2005 (JP) ..... 2005-327593

(51) Int. Cl.
*F01M 1/06* (2006.01)

(52) U.S. Cl. ..... 123/90.33; 123/90.34; 123/90.16

(58) Field of Classification Search ..... 123/90.16, 123/90.33, 90.39, 90.34
See application file for complete search history.

(56) References Cited

U.S. PATENT DOCUMENTS 5,441,020 A * 8/1995 Murata et al. ..... 123/90.16
6,684,836 B2 * 2/2004 Inoue ..... 123/90.17

FOREIGN PATENT DOCUMENTS

| | | | |
|---|---|---|---|
| DE | 32 24 945 | C1 | 2/1984 |
| DE | 42 18 078 | C1 | 1/1994 |
| DE | 195 40 028 | A1 | 4/1997 |
| DE | 100 09 776 | C1 | 4/2001 |
| DE | 103 04 971 | A1 | 6/2004 |
| JP | 07-026921 | A | 1/1995 |
| JP | 11-81955 | | 3/1999 |
| JP | 2000-337120 | A | 12/2000 |
| JP | 2001-27109 | | 1/2001 |
| JP | 2001-263015 | | 9/2001 |
| JP | 2002-242616 | | 8/2002 |
| JP | 2004-169591 | A | 6/2004 |

* cited by examiner

*Primary Examiner*—Zelalem Eshete
(74) *Attorney, Agent, or Firm*—Kenyon & Kenyon LLP

(57) ABSTRACT

The inner surface of an oil passage in a member which is made as a die-cast formed product is made as a molded surface. By this structure, permeation of oil from the inner surface of the oil passage into the thickness portion of the member which is made as a die-cast formed product, and leakage thereof out to the exterior, is prevented.

4 Claims, 10 Drawing Sheets

OIL PASSAGE CONSTRUCTION FOR DIE-CAST FORMED PRODUCT, AND OIL PASSAGE CONSTRUCTION FOR INTERNAL COMBUSTION ENGINE

INCORPORATION BY REFERENCE

The disclosure of Japanese Patent Application No.2005-327593 filed on Nov. 11, 2005, including the specification, drawings and abstract is incorporated herein by reference in its entirety.

BACKGROUND OF THE INVENTION

1. Field of Invention

The present invention relates to an oil passage construction which is provided for a die-cast formed product, and also to an oil passage construction for an internal combustion engine.

2. Description of Related Art

There is a type of internal combustion engine mounted to an automobile or the like in which oil is supplied, from an oil pressure path for supplying oil to a valve operating mechanism thereof, to a member which is attached to the exterior wall of the cylinder block or of a cam housing or the like for supporting the cam shaft. Such engines are disclosed in, for example, Japanese Patent Application Publication No. JP-A-2001-27109 and Japanese Patent Application Publication No. JP-A-2001-263015.

With an internal combustion engine such as those described above, oil passages are provided both to a member included in the internal combustion engine and to a member which is attached to the exterior thereof, in order to communicate these members with one another. Furthermore, as this type of externally attached member, there may be cited, for example, a timing chain of a cam shaft, an oil pressure type actuator of a variable valve operating mechanism, or the like. Or it would also be acceptable for this externally attached member to be some other type of appropriate auxiliary machinery.

For various components which make up an internal combustion engine, die-cast formed products are often employed, such as ones made from a light alloy material such as, for example, aluminum alloy or magnesium alloy or the like. As such die-cast formed products there may be cited, for example, a cam housing or a cylinder block or the like of the internal combustion engine.

By the way, during the manufacture of a die-cast formed product, generally, air or reaction gas is entrapped within one or more cavities in the formation mold. Due to this, minute voids termed blow holes can easily occur in the interior of the resulting die-cast formed product. However, with regard to the molded surface (for example the outer surface or the inner surface or the like) which contacts against the wall surface of the formation mold and along which the molten material which is being injected into the cavity in the formation mold is transferred, it is accepted that such blow holes cannot easily occur in its surface layer portion from its surface to a predetermined depth thereinto.

With the above described technique, if an oil passage which is to be provided in the member which is being manufactured as a die-cast formed product is formed by a cutting process, sometimes it happens that a blow hole becomes exposed upon the inner surface of this oil passage, which is undesirable. Due to this, during subsequent use of the die-cast formed product, the oil which is passing along this oil passage may permeate from this blow hole which is exposed upon the inner surface of this oil passage into a portion of the thickness of the die-cast formed product.

The situation has been investigated in which, for example, the surface of a member which is manufactured as such a die-cast formed product, such as a surface in which the opening of an oil passage is provided, is used as the mating face for an externally attached member of the type described above. For example, sometimes it is practiced to enhance the surface accuracy by eliminating the initially manufactured surface layer consisting of the above described molded surface by performing grinding finishing after the cutting process. Due to this finishing work, sometimes a portion of a blow hole becomes exposed upon the surface of the mating face, which is most undesirable.

If such a blow hole is present exposed upon the mating face surface, then there is possible that oil which has permeated from the oil passage into a thickness portion of the die-cast formed product may leak out from this surface to the exterior.

SUMMARY OF THE INVENTION

The object of the present invention is to suppress or prevent oil which is flowing in an oil passage provided in a die-cast formed product from leaking to the exterior.

A first aspect of the present invention relates to an oil passage construction, comprising a first member, which is a die-cast formed product, and which has a first oil passage, of which a predetermined range upon its inner surface is a molded surface; and a second member, having a second oil passage which is communicated with the first oil passage, and which is linked to the first member. The first member is a die-cast formed product. And a predetermined range upon the inner surface of the first oil passage is a molded surface.

It should be understood that by this molded surface, is meant a surface (for example an outer surface or an inner surface or the like) where the molten material which is injected into the cavity of the formation mold contacts against the wall surface of the formation mold and is transferred therealong. It has been determined that it is difficult for so called blow holes to occur in a surface layer portion of such a molded surface from its very outermost surface to a predetermined depth thereinto.

According to this structure, the inner surface of the oil passage is made as a molded surface upon which blow holes are not exposed. In other words, the inner surface of the oil passage is not a surface which is made by a cutting process. That is to say, a portion of the inner surface of the oil passage is a surface upon which no blow holes are exposed. For this reason, the oil which is flowing in this oil passage is prevented from permeating from the inner surface of this oil passage into the thickness portion of the die-cast formed product. Due to this, even if for example the member which consists of a die-cast formed product has a surface which is made by a cutting process, the occurrence of the phenomenon of oil leaking out from this surface is still prevented.

With this first aspect of the present invention, the surface of the first member which is linked to the second member may be formed by a cutting process. Furthermore, at least a range of the inner surface of the first oil passage of a predetermined length from its opening end where it opens to the surface which is formed by a cutting process towards the inside thereof may be a molded surface.

According to this structure, in the same manner as described above, it is possible to avoid oil permeating from the oil passage in the die-cast formed product into its thickness portion. Moreover, it is possible to avoid oil leaking to the outside from the mating face of the die-cast formed product.

The first member may be a cam housing for supporting a cam shaft which is provided upon a cylinder head of an internal combustion engine. And the second member may be an auxiliary unit which is attached to the cam housing.

According to this structure, it is possible to supply oil from the cam housing of the internal combustion engine to the auxiliary unit. Moreover, it is possible to avoid oil leakage to the exterior from the oil passage within the cam housing.

A second aspect of the present invention relates to an oil passage construction for an internal combustion engine which includes a variable valve operating mechanism, which can vary the operational characteristic of at least one of an intake valve and an exhaust valve. This variable valve operating mechanism includes: a rocker shaft upon a cylinder head which is fixedly supported parallel to a cam shaft; a control shaft which is inserted into a central axial hole of the rocker shaft so as to be displacable in the axial direction therein; a slider gear which is fitted over the outside of the rocker shaft so as to be able move together with the control shaft; a cam struck member which is fitted over the slider gear via first helical splines; a valve striker member which is fitted over the slider gear via second helical splines whose screwing direction is opposite to that of the first helical splines, and provided adjoining the cam struck member in the axial direction; and an oil pressure type actuator which changes the relative phase difference of the valve striker member with respect to the cam struck member by displacing the control shaft in its axial direction. And the oil passage construction includes: a first oil passage which is provided in a support member for supporting the cam shaft, the support member being produced by die-casting, and whose inner surface is made as a molded surface; and a second oil passage which is provided in a housing of the actuator from the side of the support member.

According to this structure, it is possible to supply oil to the actuator of the variable valve operating mechanism from the support member of the internal combustion engine. Moreover, for the same reasons as described above, it is possible to avoid oil leakage from the oil passage within the support member to the exterior.

The upstream of the first oil passage may be connected to an oil pressure path for supplying oil to a journal portion of a cam shaft.

According to this structure, it is arranged to supply oil to the oil pressure type actuator from the already existing oil pressure path which is provided to the internal combustion engine. Accordingly, the provision of a separate oil supply path to this actuator, which would be useless, is avoided.

According to the present invention, it becomes possible to suppress or prevent oil which is flowing in an oil passage provided in a die-cast formed product from leaking to the exterior.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

In the following, embodiments of the present invention will be explained with reference to the drawings. The first embodiment of the present invention will be explained with reference to FIGS. 1 through 9.

First, the structure of the internal combustion engine to which this embodiment of the present invention is applied will be explained. This internal combustion engine 1 is a four cylinder in-line type DOHC engine. And this internal combustion engine 1 is provided with a variable valve operating mechanism 3 which is capable of varying the operational characteristics of the intake valves, only, such as their lift amounts and operating angles and the like.

Figure 9:
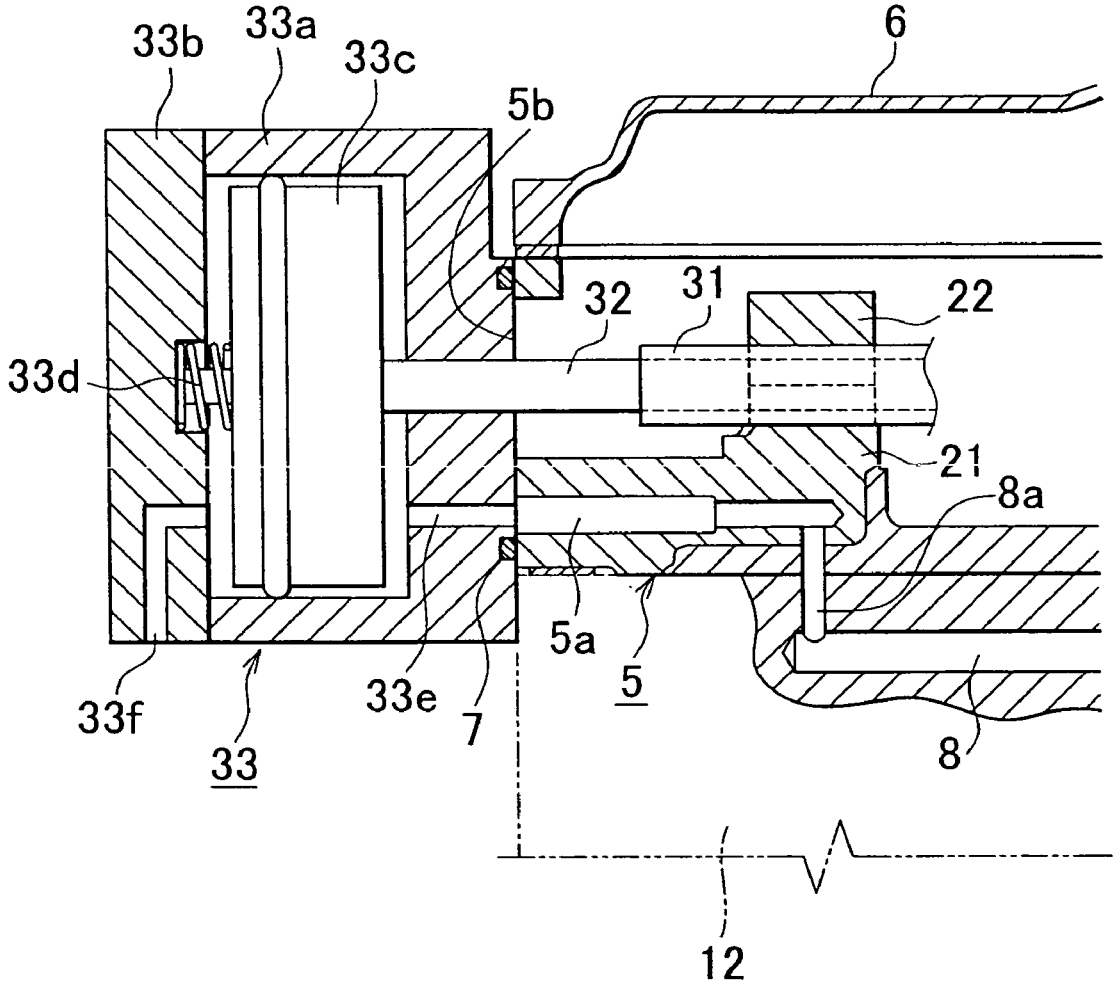
FIG. 9 is a cross sectional view taken in a plane shown by the arrows IX-IX in FIG. 1, showing in detail a portion related to the first embodiment of the present invention.

As shown in FIG. 9, a cam housing 5 is mounted upon the cylinder head 12 of this internal combustion engine 1. A head cover 6 is fitted over this cam housing 5. Dividing walls 21 are provided in this cam housing 5 at fixed intervals along the direction in which the cylinders (the combustion chambers 13) are arrayed. An intake cam shaft 16 and an exhaust cam shaft 18 are supported by these dividing walls 21.

The variable valve operating mechanism 3 comprises a rocker shaft 31, a control shaft 32, an actuator 33, and a valve lift mechanism 4.

The rocker shaft 31 is fitted through the multiple dividing walls 21 in the cam housing 5 upon the cylinder head 12. The rocker shaft 31 is held fixed by the dividing walls 21 both in its axial direction and also in its circumferential direction. And the rocker shaft 31 is disposed parallel with the intake cam shaft 16. In other words, the rocker shaft 31 is arranged along the direction in which the cylinders of this internal combustion engine (i.e. the combustion chambers 13) are arrayed.

The control shaft 32 is inserted into a central axial hole in the rocker shaft 31, which thus constitutes a hollow pipe, so as to be capable of being displaced along the axial direction thereof. This control shaft is driven forwards and backwards along its axial direction by the actuator 33.

The same number of the valve lift mechanisms 4 are provided, as there are cylinders in this internal combustion engine 1. These valve lift mechanisms 4 are fitted outside and around the rocker shaft 31, so that one thereof corresponds to each one of the cylinders.

Figure 1:
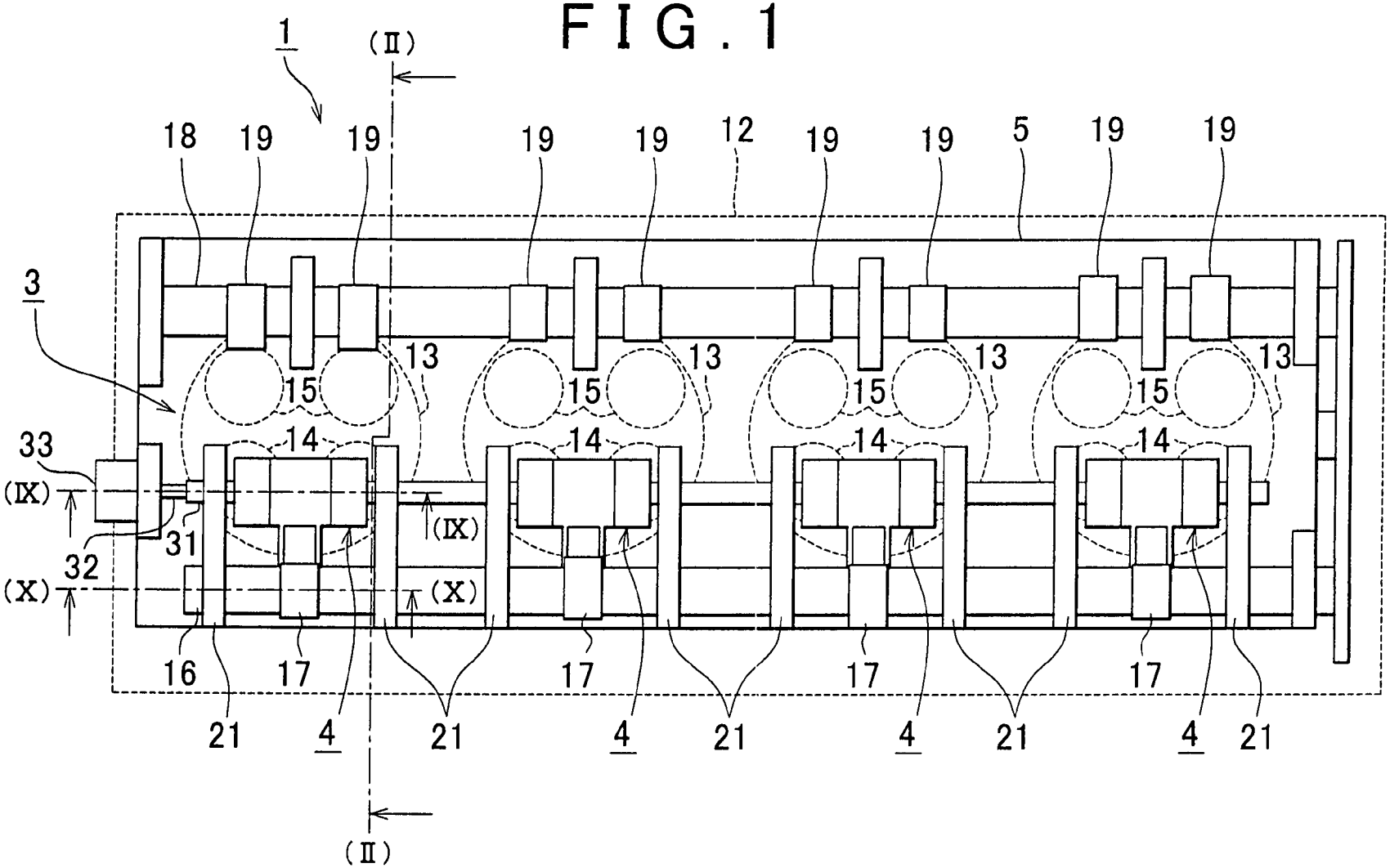
FIG. 1 is a plan view schematically showing a variable valve operating mechanism of an internal combustion engine according to a first embodiment of the present invention.
Figure 2:
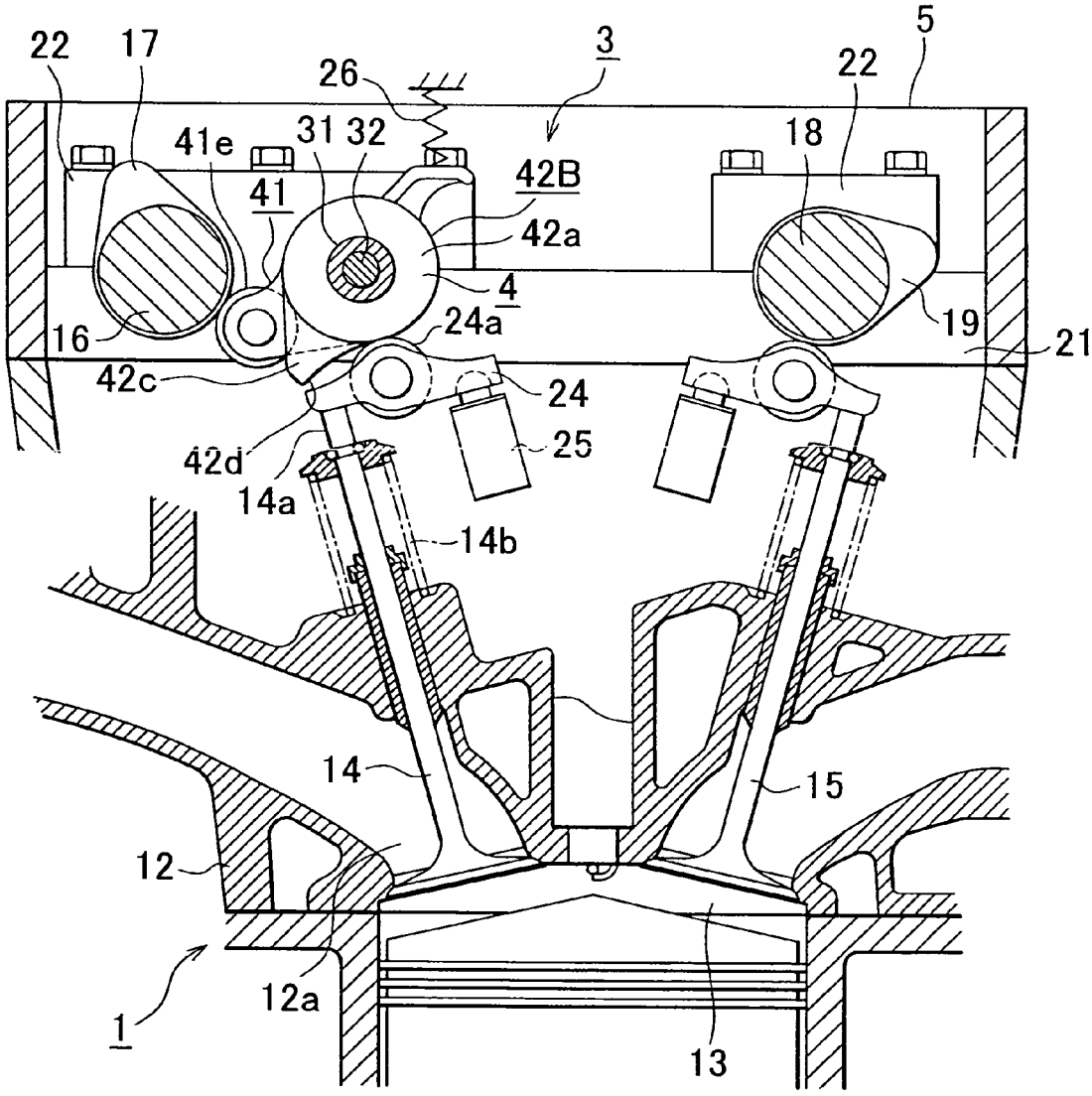
FIG. 2 is a cross sectional view of the structure of FIG. 1, taken in a plane shown by the arrows II-II in FIG. 1.
Figure 3:
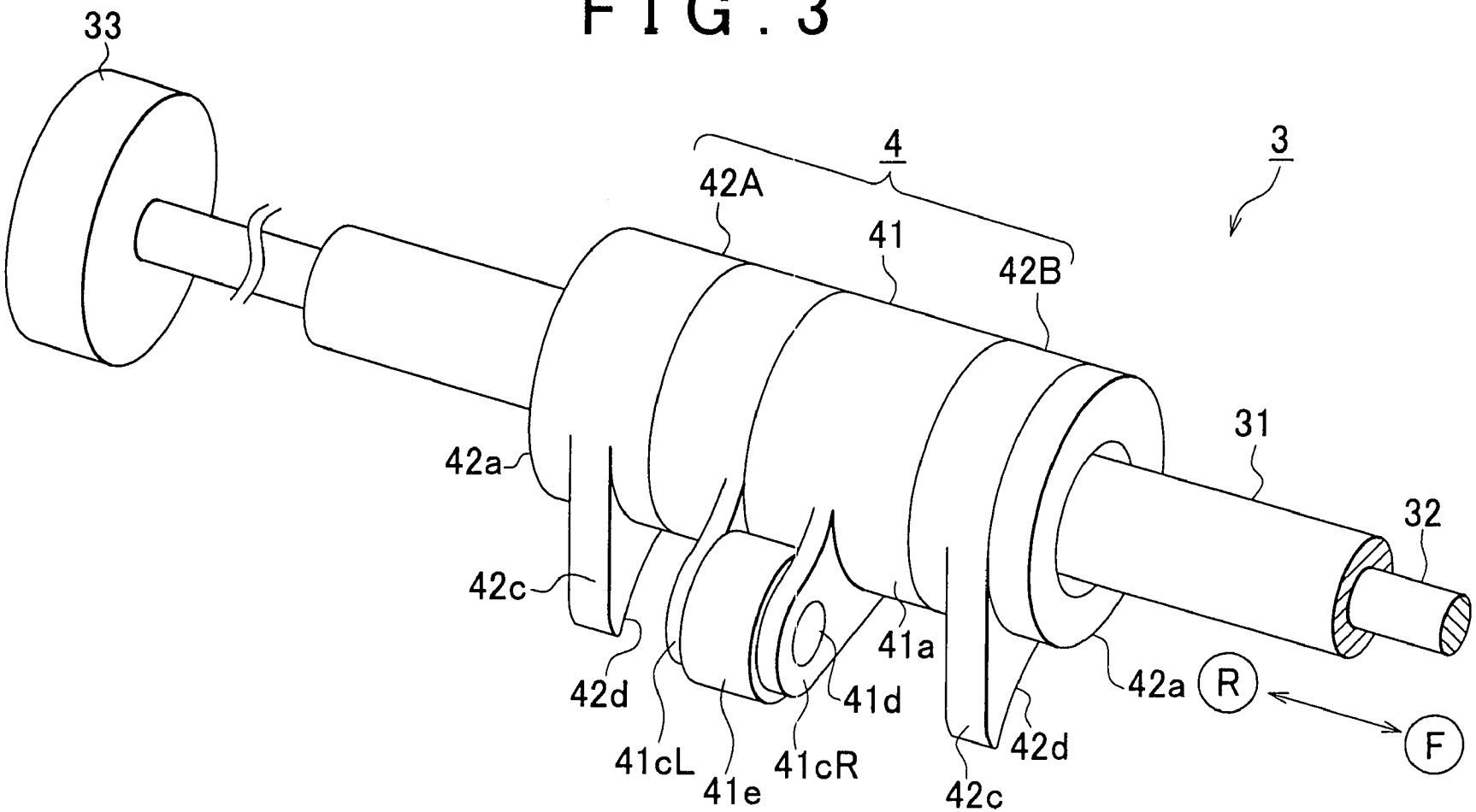
FIG. 3 is a perspective view of the variable valve operating mechanism of FIG. 1.
Figure 4:
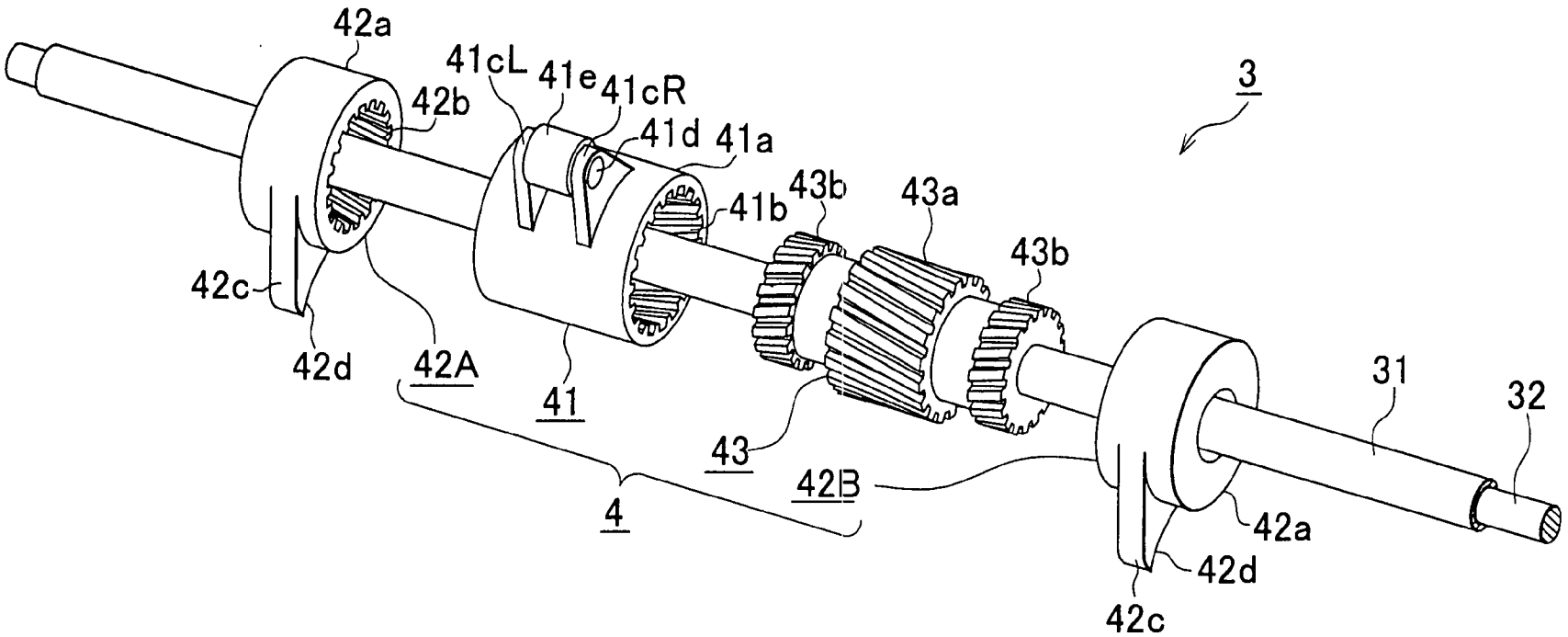
FIG. 4 is an exploded perspective view of a valve lift mechanism of FIG. 1.

Referring to FIGS. 2 through 4 which show the structure of one of these valve lift mechanisms 4 in detail, this valve lift mechanism 4 is provided between an intake cam 17 of the intake cam shaft 16 and a rocker arm 24. The valve lift mechanism 4 comprises an input arm 41, which is a cam struck member. Furthermore, the valve lift mechanism 4 comprises two output arms 42A and 42B which are valve striker members, and a slider gear 43. It should be understood that, according to requirements, sometimes the input arm 41 and the two output arms 42A and 42B will herein be termed an "arm assembly".

Moreover, it should be understood that one end of the rocker arm 24 is supported upon an oil pressure type lash adjuster 25. The other end of the rocker arm 24 contacts against a tappet 14*a* at the stem end of the intake valve 14. At an intermediate position along the longitudinal direction of the rocker arm 24, rollers 24*a* are supported so as to be freely rotatable. This rocker arm 24 is termed an end pivoted type. The oil pressure type lash adjuster 25 keeps the tappet clearance of the intake valve 14 always at zero. This lash adjuster 25 is of a per se known type.

The input arm 41 has a hollow cylindrical housing 41*a*. On the inner circumferential surface of this housing 41*a*, there are formed helical splines 41*b* which mesh with center helical splines 43*a* of the slider gear 43. Furthermore, on the outer surface of the housing 41*a*, there are formed a pair of forks 41*c*L and 41*c*R which project outwards in the radial direction. A roller 41*e* is rotatably supported between this pair of forks 41*c*L and 41*c*R upon a support shaft 41*d* which runs parallel to the rocker shaft 31.

The two output arms 42A and 42B are of the same shape. Each of these output arms 42A and 42B has a cylindrical housing 42*a*. On the inner circumferential surfaces of these housings 42*a*, there are formed helical splines 42*b* which mesh with side helical splines 43*b* of the slider gear 43. Moreover, a nose 42*c* which projects outward in the radial direction towards one side is formed on the outer surface of each of these housings 42*a*. This nose 42*c* is formed in an approximately triangular shape as seen from the side. One side of this nose 42*c* constitutes a cam face 42*d*. These cam faces 42*d* of the output arms 42A and 42B are arranged to contact against the roller 24*a* of the rocker arm 24.

The slider gear 43 is provided on the outside of the rocker shaft 31. This slider gear 43 is shiftable along its axial direction together with the control shaft 32. The input arm 41 and the two output arms 42A and 42B are provided on the outside of the slider gear 43.

Figure 5:
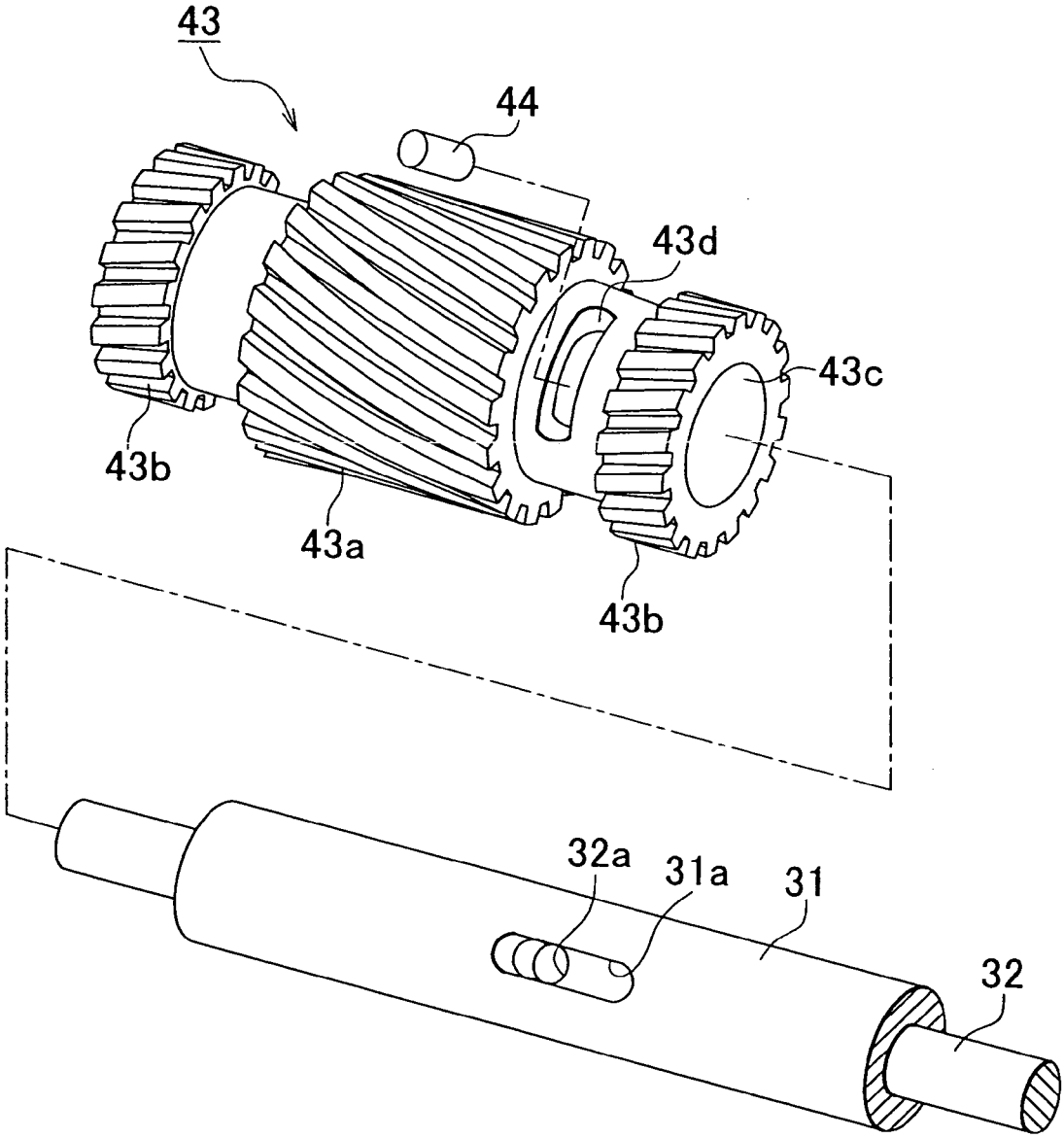
FIG. 5 is an exploded perspective view showing the relationship between a slider gear of the valve lift mechanism of FIG. 4 and a rocker shaft.
Figure 6:
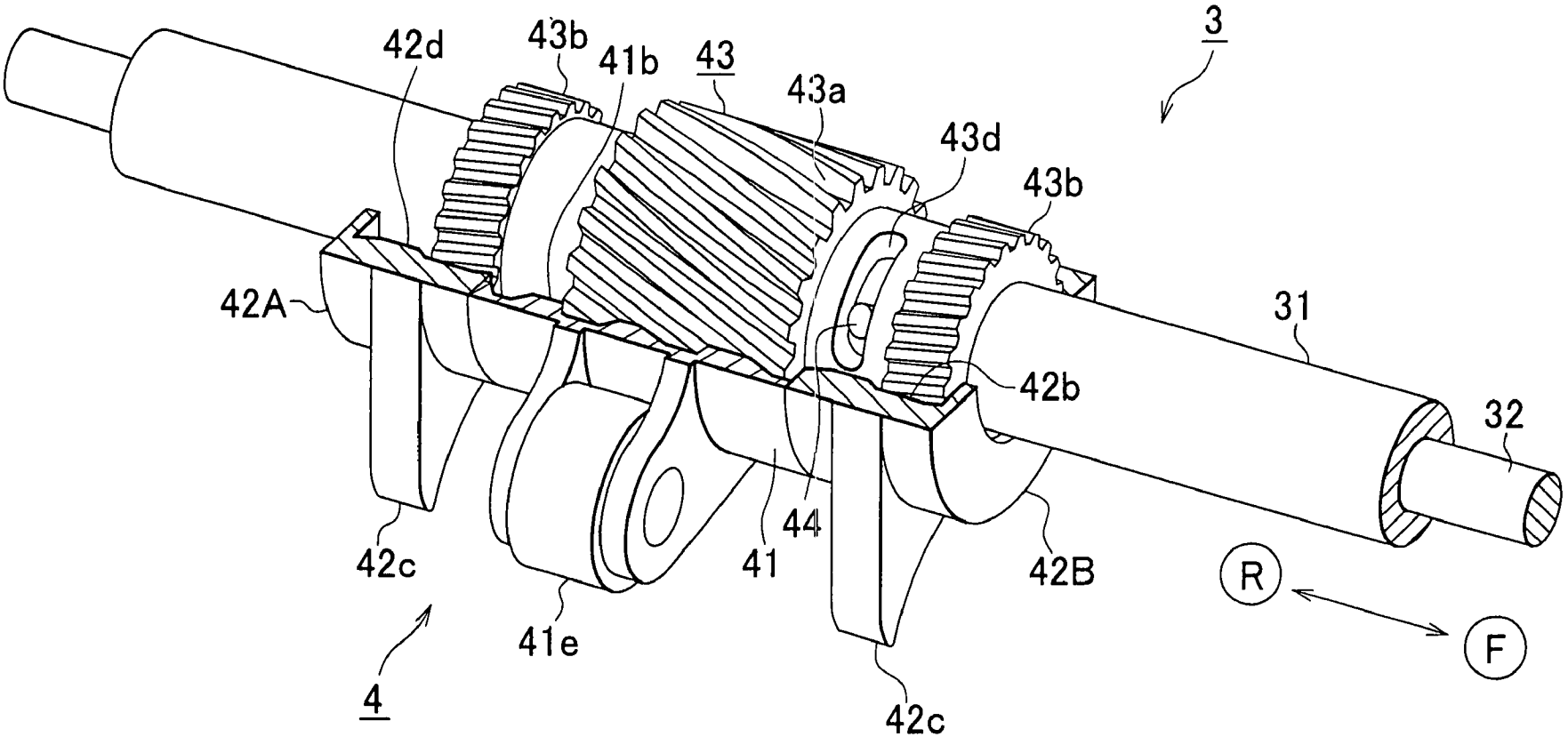
FIG. 6 is a perspective view showing the valve lift mechanism of FIG. 4 with its upper half cut away.

Referring now to FIG. 5, this slider gear 43 is formed in a cylindrical shape and has a central through hole 43*c*. On the outer periphery of this slider gear 43, in an axially intermediate direction thereof, the aforementioned center helical splines 43*a* which are meshed with the helical splines 41*b* of the input arm 41 are formed. Furthermore, on the outer periphery of this slider gear 43, at both sides thereof in the axial direction, the aforementioned helical splines 43*b* which mesh with the helical splines 42*b* of the output arms 42A and 42B are formed. These side helical splines 43*b* are formed with a smaller external diameter, as compared with the center helical splines 43*a*. The center helical splines 43*a* and the side helical splines 42*b* are formed so as to have opposite inclinations, in other words, so as to screw in opposite directions.

It should be understood that the roller 41*e* of the input arm 41 is biased by a spring 26 so as always to be pressed against the intake cam 17. This spring 26 is a lost motion spring which is provided to the cylinder head 12 in a compressed state. The rollers 24*a* of the rocker arm 24 are pressed into contact with the cam faces 42*d* of the housings 42*a* of the output arms 42A and 42B by the valve spring 14*b* of the intake valve 14.

Now, the manner in which the rocker shaft 31 and the control shaft 32 are coupled together by the slider gear 43 will be explained.

Through the slider gear 43, and between the center helical splines 43*a* and the side helical splines 43*b* on one side, there is pierced a slot 43*d* which extends along the circumferential direction. Furthermore, at a spot on the rocker shaft 31 which corresponds to this slot 43*d* in the slider gear 43, there is provided a slot 31*a* which is pierced from the interior to the exterior in the radial direction, and which extends along the axial direction. Moreover, a through hole 32*a* is provided at a spot on the control shaft 32 which corresponds to this slot 31*a* in the rocker shaft 31.

The rocker shaft 31 is inserted into the through hole 43*c* in the slider gear 43. At the spot where the slot 43*d* of the slider gear 43 and the slot 31*a* of the rocker shaft 31 intersect, an engagement pin 44 is inserted. One end of this engagement pin 44 is fixed in the insertion hole 32*a* of the control shaft 32, which has been inserted within the rocker shaft 31. It should be understood that the width in the axial direction of the slot 43*d* in the slider gear 43 is set to be slightly greater than the diameter of this engagement pin 44. The reason for doing this is in order to permit movement of the engagement pin 44 within the slot 43*d* of the slider gear 43.

The slider gear 43 which has been assembled in this manner operates. as will now be described.

(a) The engagement pin 44 is able to shift along the slot 31*a* of the rocker shaft 31. Due to this, when the control shaft 32 is shifted along its axial direction by the actuator 33, the slider gear 43 shifts along the axial direction, along with the control shaft 32.

(b) The engagement pin 44 is inserted into the slot 43*d* of the slider gear 43. When the torque of the intake cam shaft 16 is transmitted to the input arm 41, the slider gear 43 pivots around the rocker shaft 31.

With the valve lift mechanism 4 of this type, the control shaft 32 shifts along the axial direction along with the slider gear 43. Due to this, the relative position of the slider gear 43 and the arm assembly (the input arm 41 and the output arms 42A and 42B) changes. As a result, torsional forces in mutually opposite directions are imparted to the input arm 41 and the output arms 42A and 42B. Due to this, the input arm 41 and the output arms 42A and 42B are rotated relative to one another. And the relative phase difference between the input arm 41 (specifically, its roller 41*e*) and the output arms 42A and 42B (specifically, their noses 42*c* is thereby varied.

It should be understood that, in the above described variable valve operating mechanism 3, the valve lift mechanisms 4 for each of the cylinders are all fixed upon a single control shaft 32 which is common to all of them. Due to this, it is arranged to vary the lift amounts of the intake valves 14 for all of the cylinders together at the same time, along with axial shifting of this common control shaft 32. However, it would also be possible to arranged for the valve lift mechanisms 4 of the various cylinders to be operated individually, and this embodiment of the present invention would also be applicable in such a case as well.

Next, the fundamental operation of the variable valve operating mechanism will be explained.

First, suppose that the control shaft 32 is shifted to its maximum limit in the direction away from the actuator 33 (i.e. it the direction shown in FIG. 3 by the arrow sign F). In this state, the relative phase difference around the axis of the rocker shaft 31 between the roller 41*e* of the input arm 41, and the noses 42*c* of the output arms 42A and 42B, is at its maximum.

Figure 7B:
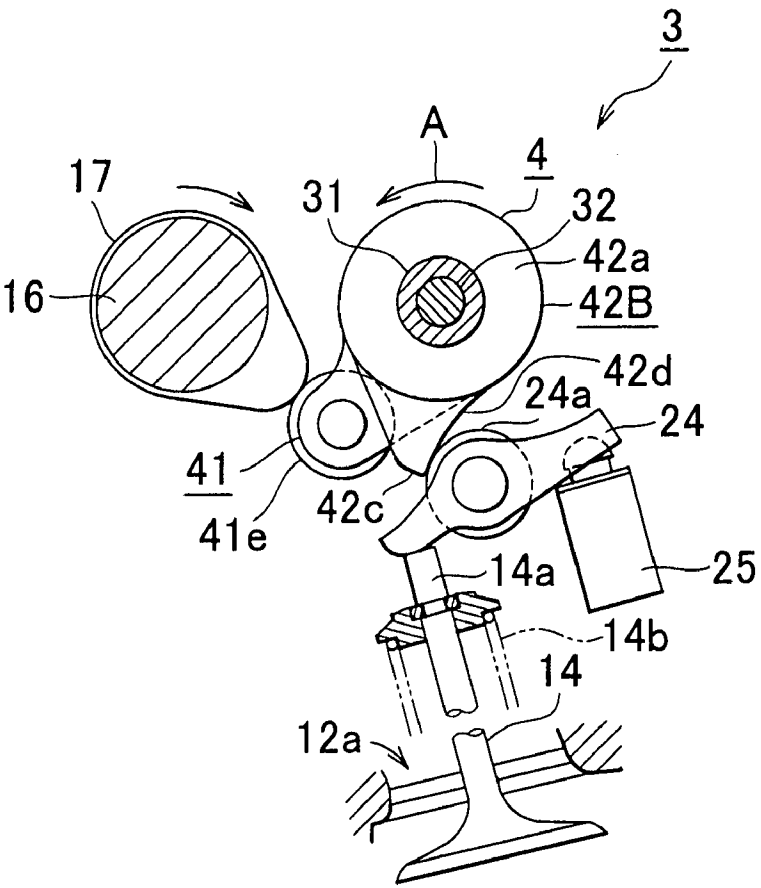
FIGS. 7A and 7B are side views for explanation of the operation of the mechanism of FIG. 2 when the relative phase difference between an input arm and an output arm is maximum.
Figure 7A:
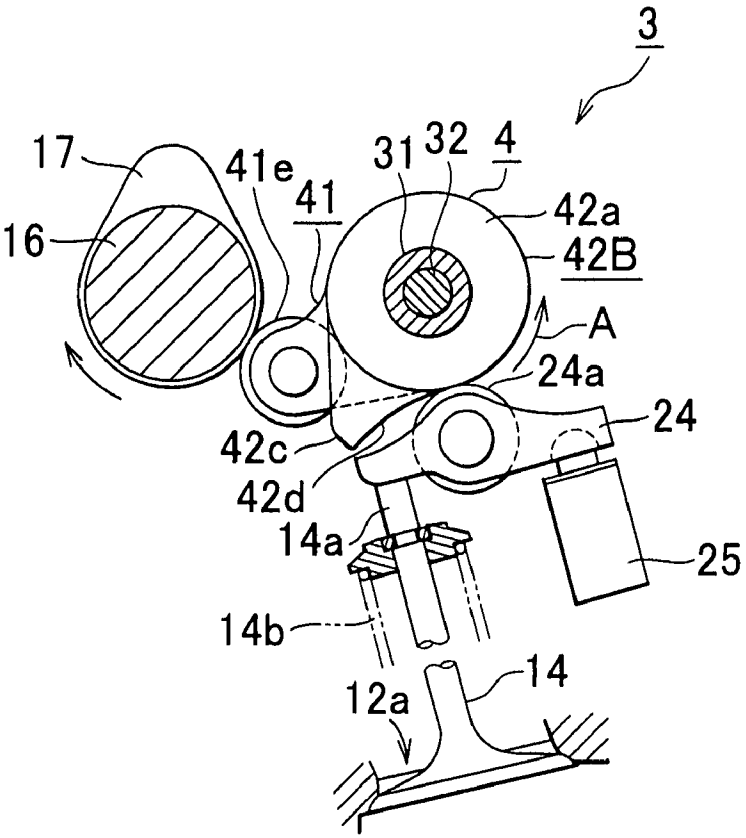

In this state, as shown in FIG. 7A, while the base circular portion of the intake cam 17 is contacted against the roller 41*e* of the input arm 41, the rocker arm 24 is not tilted. As a result, a state is maintained in which the lift amount of the intake valve 14 is zero (i.e. the state in which the intake port 12*a* is closed).

Subsequently, as shown in FIG. 7B, along with the further rotation of the intake cam shaft 16 in the clockwise direction, the roller 41*e* of the input arm 41 is pressed to its maximum limit by the convex portion of the intake cam 17. At this time, the input arm 41 is rotated in the direction shown by the arrow sign A (i.e. in the counter-clockwise direction). Along with this rotation of the input arm 41, the output arms 42A and 42B and the slider gear 43 are rotated together. Due to this, as shown in FIG. 7B, the rollers 24*a* of the rocker arm 24 are pressed downward by the noses 42*c* of the output arms 42A and 42B. And the rocker arm 24 tilts around its point of contact with the lash adjuster 25 as a fulcrum, and presses the intake valve 14 downwards. As a result, the intake valve 14 comes to be opened to its maximum lift amount and operating angle.

On the other hand, suppose that the control shaft 32 is shifted to its maximum limit in the direction towards the actuator 33 (i.e. it the direction shown in FIG. 3 by the arrow sign R). In this state, the relative phase difference around the axis of the rocker shaft 31 between the roller 41*e*, and the noses 42*c*, is at its minimum.

Figure 8B:
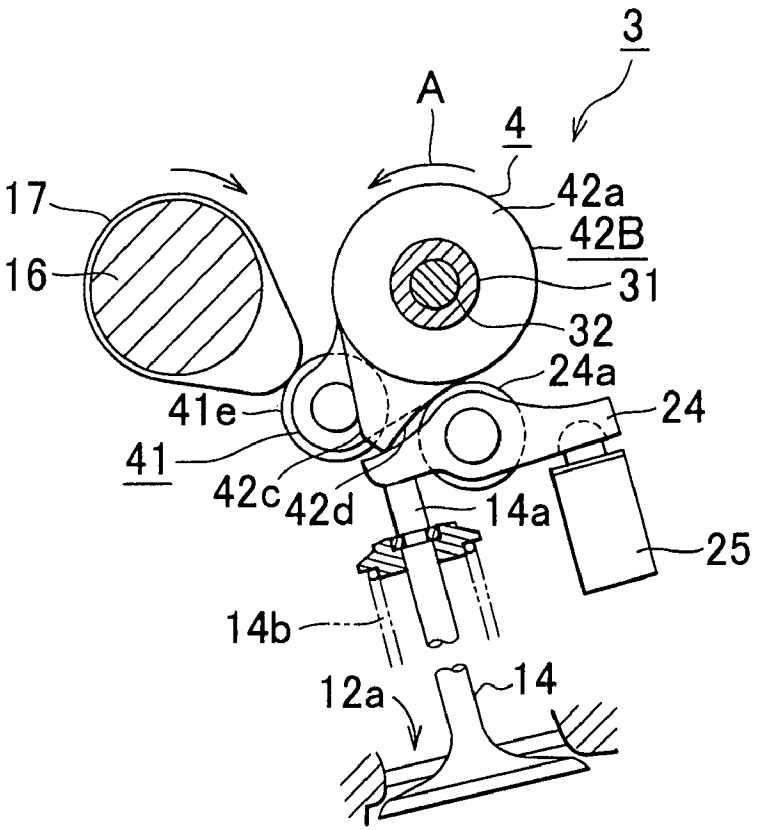
FIGS. 8A and 8B are side views for explanation of the operation of the mechanism of FIG. 2 when the relative phase difference between an input arm and an output arm is minimum.
Figure 8A:
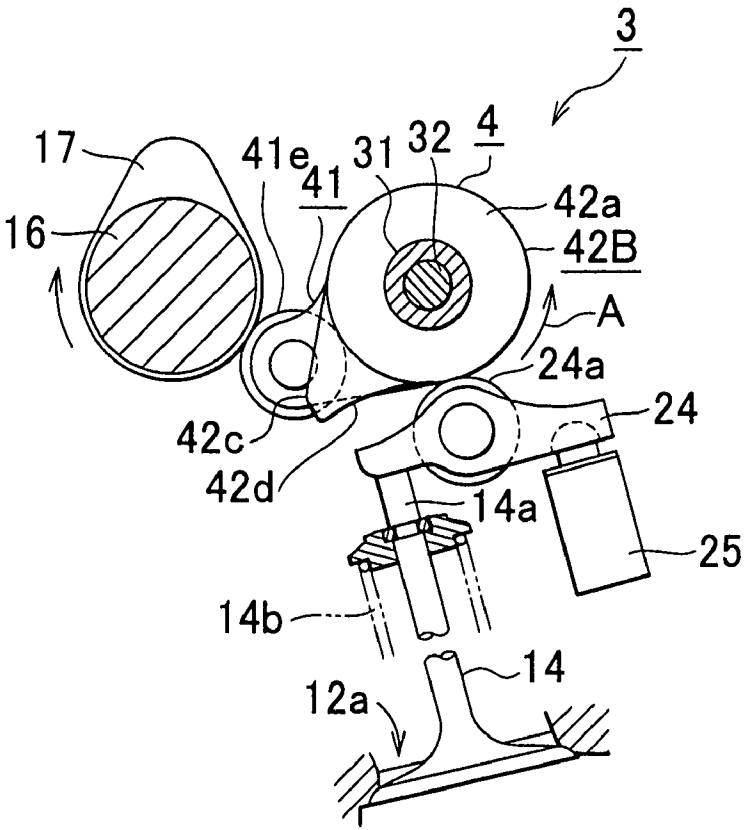

In this state, as shown in FIG. 8A, while the base circular portion of the intake cam 17 is contacted against the roller 41*e* of the input arm 41, the rocker arm 24 is not tilted. As a result, the state is maintained in which the lift amount of the intake valve 14 is zero (i.e. the state in which the intake port 12*a* is closed).

Subsequently, as shown in FIG. 8B, along with the further rotation of the intake cam shaft 16 in the clockwise direction, the roller 41*e* of the input arm 41 is pressed to its maximum limit by the convex portion of the intake cam 17. When this is done, the input arm 41 is rotated together with the output arms 42A and 42B in the direction shown by the arrow sign A (i.e. in the counter-clockwise direction). However, the noses 42*c* are not contacting against the rollers 24*a* of the rocker arm 24. As a result, the rocker arm 24 is not tilted at all, and the lift amount of the intake valve 14 is kept at zero.

Next, the structure of this embodiment of the present invention will be explained.

An oil pressure path 8 supplies oil to the cam journal portions of the intake cam shaft 16 and the exhaust cam shaft 18. An oil passage 5*a* is provided in the cam housing 5. And an oil passage 33*e* is provided in the housing 33*a* of the actuator 33 of the variable valve operating mechanism 3. Oil from the oil pressure path 8 passes along the oil passage 5*a* and is supplied to the oil passage 33*e*. In this construction for supply of oil, arrangements are implemented for preventing oil leakage to the exterior.

In concrete terms, as shown in FIG. 9, the oil pressure type actuator 33 of the variable valve operating mechanism 3 is attached to the exterior wall surface of the cam housing 5 at one end thereof in its longitudinal direction. This actuator 33 of this embodiment may be considered as the "second member" of the present invention. This actuator 33 comprises a housing 33*a*, an end cover 33*b*, a piston 33*c*, and a return spring 33*d*. An oil passage 33*e* which is provided in the housing 33*a* is communicated with a first oil pressure chamber defined between the piston 33*c* and the bottom surface of the housing 33*a*. Furthermore, an oil passage 33*f* which is provided in the end cover 33*b* is communicated with a second oil pressure chamber defined between the piston 33*c* and the end cover 33*b*.

The dividing wall 21 supports journal portions of the intake cam shaft 16 and the exhaust cam shaft 18 at a cam housing 5. A branch off conduit 8*a* is provided in the dividing wall 21, and conducts oil from an oil pressure path provided in the cylinder head 12 to the journal portions of these cam shafts 16 and 18.

It should be understood that the rocker shaft 31 fits into a concave portion on the top of the dividing wall 21. The rocker shaft 31 is held into and pressed against the dividing wall 21 by a cam cap 22 which is coupled thereto by bolts or the like.

Furthermore, an oil passage 5*a* is provided in the dividing wall 21 of the cam housing 5. This oil passage 5*a* is a junction oil passage which communicates with and links the branch off conduit 8*a* and the oil passage 33*e* which is provided in the housing 33*a* of the actuator 33.

In this embodiment of the present invention, the cam housing 5 is a die-cast formed product made from a light alloy material such as an aluminum alloy or a magnesium alloy or the like. Due to this, blow holes are generally present in the thickness portion of the cam housing 5, although they may be minute ones.

An opening of the junction oil passage 5*a* is provided in this cam housing 5 which is a die-cast formed product. The mating face 5*b* in the cam housing 5 onto which the actuator 33 is fitted has a high surface accuracy, since it is subjected to grinding finishing by, for example, a cutting process. For this reason, this mating face 5*b* constitutes a cutting process face upon which the surface layer portion, which is the molded surface during initial manufacture, has been eliminated. Accordingly, the surface of this mating face 5*b* is in a state in which some blow holes are exposed on at least a portion of its surface. It should be understood that a seal 7 such as an O□ring or the like is interposed between the housing 33*a* of the actuator 33 and the mating face 5*b*.

The junction oil passage 5*a* which is formed in the interior of the cam housing 5 is made by removal of a mold. For this reason, the inner surface which defines this oil passage Sa constitutes a molded surface.

This oil passage 5*a* is a hole left by mold removal. The inner diameter dimension of the oil passage Sa gradually increases towards its opening end. Due to this, it becomes very easy to remove the formation mold from the oil passage 5*a*.

As explained above, in this embodiment, the inner surface of the oil passage 5*a* of the cam housing 5, which is a die-cast formed product, is made as a molded surface. Accordingly, no blow holes are exposed upon any portion of the oil passage 5*a* of this embodiment, as would be the case if it were a surface formed by a cutting process.

For this reason, the oil which is flowing in the oil passage 5*a* of the cam housing 5 is prevented from permeating from the inner surface of this oil passage 5*a* into the thickness portion of the cam housing 5. Due to this, even if, hypothetically, blow holes are exposed on the mating face 5*b* of the cam housing 5, which is a surface formed by a cutting process, nevertheless it is possible to avoid the occurrence of the phenomenon of oil leaking out from this mating face 5*b*. Accordingly, it is arranged to be possible to prevent leakage of oil from the oil passage 5*a* of the cam housing 5 to the exterior. As a result, it is possible to enhance the reliability from the point of view of elimination of oil leakage from the cam housing 5.

In the following, variations of this embodiment will be explained.

Figure 10:
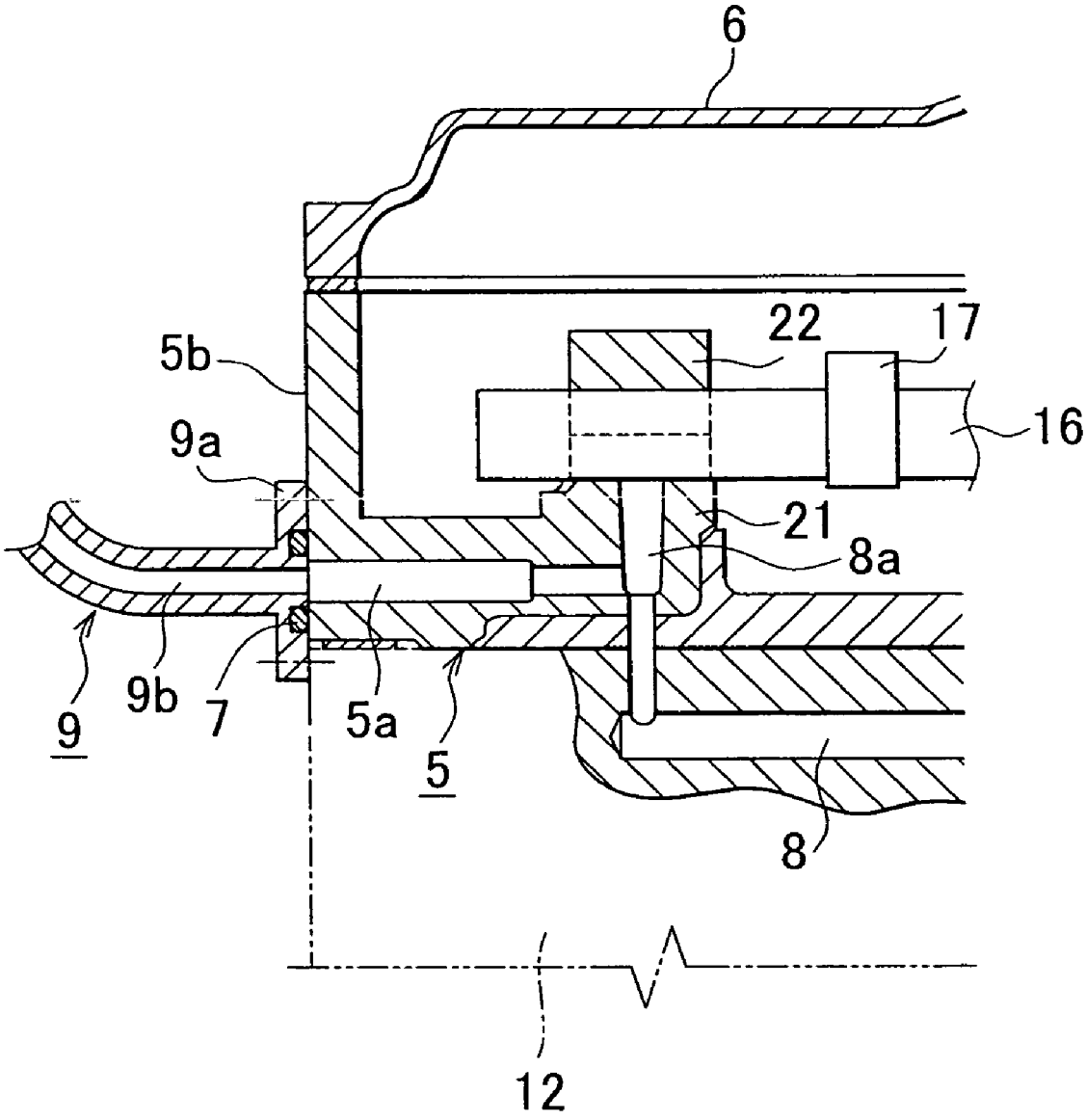
FIG. 10 is a cross sectional view taken in a plane shown by the arrows X-X in FIG. 1, showing in detail a portion related to another embodiment of the present invention.

(1) In the above described embodiment, the actuator 33 of the variable valve operating mechanism 3 is cited as a concrete example of an "second member". However, as shown in FIG. 10, instead of being the actuator 33, it would also be possible for this "second member" to be a bypass pipe 9 or the like for supplying oil to some other device which employs oil (not shown in the figure).

This bypass pipe 9 is fitted via a flange shaped fitting flange 9*a* to the mating face 5*b* of the cam housing 5 by bolts or the like. An oil passage 9*b* which is provided in the interior of this bypass pipe 9 is arranged to be communicated with the oil passage 5*a* in the cam housing 5. It should be understood that a seal 7 such as an O□ring or the like is interposed between the fitting flange 9*a* and the mating face 5*b*. In this case as well, the same operation and the same beneficial effects are obtained, as with the embodiment described above.

(2) In the embodiment described above, the die-cast formed product is the cam housing 5 of the internal combustion engine 1. However, the die-cast product of the present invention may be some other member. For example, it would also be possible for the housing 33*a* of the actuator 33 in the embodiment described above to be a die-cast formed product which is made from an appropriate light alloy material. In this case, by forming the oil passage 33*e* which is provided in the housing 33*a* by mold removal, it would also be possible to make the inner surface of the oil passage 33*e* as a molded surface.

(3) With the internal combustion engine 1 of the embodiment described above, only the operational characteristic of the intake valves 14 is varied. However, it would also be acceptable to arrange to vary the operational characteristic of the exhaust valves 15 as well.

(4) In the embodiment described above, the cam housing 5 which is provided to the internal combustion engine 1 is taken as being one example of a die-cast formed product. However, it would also be acceptable to arranged for a member which is provided to some appropriate device other than an internal combustion engine 1 to be made as a die-cast formed product. In other words, a construction would also be acceptable in which oil is supplied from this die-cast formed product to a member which is linked thereto.

(5) In the embodiment described above, the entire inner surface of the oil passage 5*a* of the cam housing 5 is made as a molded surface. However, it would also be acceptable to make only, at least, a section of a predetermined length from the opening end of the oil passage 5*a* to a predetermined position in the depth direction, as a molded surface.

While the invention has been described with reference to what are considered to be preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single element, are also within the spirit and scope of the invention.

What is claimed is:

1. An oil passage construction for an internal combustion engine that includes a variable valve operating mechanism which can vary an operational characteristic of at least one of an intake valve and an exhaust valve, the oil passage construction, comprising:

a first member, which is a die-cast formed product, and which has a first oil passage, of which a predetermined range upon its inner surface is a molded surface; and a second member, having a second oil passage which is communicated with the first oil passage, which is linked to the first member, wherein a surface of the first member, which is linked to the second member, is formed by a cutting process, and at least a range of the inner surface of the first oil passage being of a predetermined length from its opening end towards the inside thereof is a molded surface wherein the opening end is provided at the surface formed by the cutting process, wherein the first member is a cam housing for supporting a cam shaft which is provided upon a cylinder head of the internal combustion engine, and the second member is an auxiliary unit which is attached to the cam housing, and wherein the variable valve operating mechanism includes:

a rocker shaft located on a cylinder head which is fixedly supported parallel to the cam shaft; and a control shaft which is inserted into a central axial hole of the rocker shaft so as to be displaceable in an axial direction therein, wherein the first oil passage is provided between the cylinder head and the control shaft.

2. An oil passage construction for an internal combustion engine that includes a variable valve operating mechanism which can vary an operational characteristic of at least one of an intake valve and an exhaust valve; the oil passage construction comprising:

a first oil passage which is provided in a support member for supporting a cam shaft, the support member being produced by die-casting, and whose inner surface is made as a molded surface; and a second oil passage which is provided in a housing of an oil pressure actuator from a side of the support member, wherein the variable valve operating mechanism includes a rocker shaft upon a cylinder head which is fixedly supported parallel to the cam shaft;

a control shaft which is inserted into a central axial hole of the rocker shaft so as to be displacable in an axial direction therein;

a slider gear which is fitted over the outside of the rocker shaft so as to be able to move together with the control shaft;

a cam struck member which is fitted over the slider gear via first helical splines;

a valve striker member which is fitted over the slider gear via second helical splines whose screwing direction is opposite to that of the first helical splines, and provided adjoining the cam struck member in the axial direction; and the oil pressure actuator which changes a relative phase difference of the valve striker member with respect to the cam struck member by displacing the control shaft in its axial direction.

3. The oil passage construction according to claim 2, wherein an upstream of the first oil passage is connected to an oil pressure path for supplying oil to a journal portion of the cam shaft.

4. An oil passage construction for an internal combustion engine that includes a variable valve operating mechanism which can vary an operational characteristic of at least one of an intake valve and an exhaust valve, the oil passage construction, comprising:

a first member, which is a die-cast formed product, and which has a first oil passage, of which a predetermined range upon its inner surface is a molded surface; and a second member, having a second oil passage which is communicated with the first oil passage, which is linked to the first member, wherein a surface of the first member, which is linked to the second member, is formed by a cutting process, and at least a range of the inner surface of the first oil passage being of a predetermined length from its opening end towards the inside thereof is a molded surface wherein the opening end id provided at the surface formed by the cutting process, wherein the first member is a cam housing for supporting a cam shaft which is provided upon a cylinder head of an internal combustion engine, and the second member is an auxiliary unit which is attached to the cam housing, and wherein the first oil passage is provided between the cylinder head and the cam shaft, wherein the variable valve operating mechanism includes:

a rocker shaft located on a cylinder head which is fixedly supported parallel to the cam shaft; and a control shaft which is inserted into a central axial hole of the rocker shaft so as to be displaceable in an axial direction therein, wherein the first oil passage is provided between the cylinder head and the control shaft.

* * * * *

UNITED STATES PATENT AND TRADEMARK OFFICE

CERTIFICATE OF CORRECTION

PATENT NO. : 7,614,373 B2
APPLICATION NO. : 11/593031
DATED : November 10, 2009
INVENTOR(S) : Junpei Shouji et al.

It is certified that error appears in the above-identified patent and that said Letters Patent is hereby corrected as shown below:

| Column | Line | |
|---|---|---|
| 8 | 42 | Change "oil passage Sa" to --oil passage **5**a--. |
| 8 | 45 | Change "oil passage Sa" to --oil passage **5**a--. |

Signed and Sealed this

Eleventh Day of May, 2010

David J. Kappos

David J. Kappos
*Director of the United States Patent and Trademark Office*